US006059458A

United States Patent [19]

Belias et al.

[11] Patent Number: 6,059,458

[45] Date of Patent: May 9, 2000

[54] ELASTIC TOP DRAWTAPE BAG AND METHOD OF MANUFACTURING THE SAME

[75] Inventors: William P. Belias, Pittsford; Catherine E. Gueli, Rochester; Lawrence J. Glod, Sr., Canandaigua, all of N.Y.

[73] Assignee: Tenneco Packaging, Inc., Lake Forest, Ill.

[21] Appl. No.: 09/244,865

[22] Filed: Feb. 5, 1999

[51] Int. Cl.[7] ..... B65D 33/28

[52] U.S. Cl. ..... 383/75; 383/24; 383/33; 493/225; 220/495.11

[58] Field of Search ..... 383/75, 72, 33, 383/43, 24; 220/495.06, 495.08, 495.11; 493/212, 213, 225, 186

[56] References Cited

U.S. PATENT DOCUMENTS

| | | |
|---|---|---|
| 463,597 | 11/1891 | Cussen . |
| 467,108 | 1/1892 | Cussen . |
| 835,673 | 11/1906 | Fross . |
| 916,802 | 3/1909 | Thompson . |
| 1,092,955 | 4/1914 | Shaver . |
| 1,095,790 | 5/1914 | Blumel . |
| 1,751,473 | 3/1930 | Deubener . |
| 2,125,758 | 8/1938 | Waters . |
| 2,242,799 | 5/1941 | Moore . |
| 2,254,510 | 9/1941 | Bergstein . |
| 2,280,601 | 4/1942 | Otter . |
| 2,358,455 | 9/1944 | Hallman . |
| 2,458,173 | 1/1949 | Kardon . |
| 2,524,030 | 10/1950 | Allen . |
| 2,551,044 | 5/1951 | Ottinger et al. . |
| 2,555,820 | 6/1951 | Satz . |
| 2,609,317 | 9/1952 | Vogt . |
| 2,635,510 | 4/1953 | Grant . |
| 2,652,187 | 9/1953 | Steen et al. . |
| 2,660,219 | 11/1953 | Haas et al. . |
| 2,718,105 | 9/1955 | Ferguson et al. . |
| 2,741,956 | 4/1956 | Diffenbaugh . |
| 2,762,271 | 9/1956 | Mead . |
| 2,777,491 | 1/1957 | Ashton et al. . |
| 2,883,913 | 4/1959 | Piazze . |
| 2,886,085 | 5/1959 | Sanger . |
| 2,893,468 | 7/1959 | Fieroh . |
| 2,897,729 | 8/1959 | Ashton et al. . |
| 2,958,365 | 11/1960 | Molins et al. . |
| 2,971,874 | 2/1961 | Canno . |
| 2,998,842 | 9/1961 | Good . |
| 3,006,257 | 10/1961 | Orsini . |
| 3,010,640 | 11/1961 | Kugler . |
| 3,023,948 | 3/1962 | Hoeppner . |

(List continued on next page.)

FOREIGN PATENT DOCUMENTS

| | | |
|---|---|---|
| 759814 | 5/1967 | Canada . |
| 1183880 | 7/1959 | France . |
| 1236831 | 6/1960 | France . |
| 1582939 | 10/1969 | France . |
| 2430895 | 3/1980 | France . |
| 22 15 612 | 10/1973 | Germany . |
| 27 32 085 | 1/1979 | Germany . |
| 28 33 119 | 2/1980 | Germany . |
| 38 05 054 | 8/1989 | Germany . |
| 1125363 | 8/1968 | United Kingdom . |
| 1176612 | 1/1970 | United Kingdom . |
| 2009098 | 6/1979 | United Kingdom . |

*Primary Examiner*—Allan N. Shoap
*Assistant Examiner*—Robin A Hylton
*Attorney, Agent, or Firm*—Jenkens & Gilchrist

[57] ABSTRACT

A drawtape bag comprises a pair of pliable thermoplastic body panels joined to each other along a pair of opposing sides and a bottom bridging the opposing sides. The bag may be opened along the mouth end formed opposite the bottom. At least one of the body panels forms a hem along the mouth end of the bag, and the hem houses a pliable thermoplastic drawtape. One or more drawtape holes located within the hem expose the drawtape allowing it to be pulled through the holes to close the bag and to be used as a handle. The elastic top feature is provided by an elastomeric strip connected to a looped section of the drawtape housed within the hem. Specifically, the drawtape section is gathered into one or more loops defining a series of crests and troughs, and each trough is sealed to the elastomeric strip.

19 Claims, 5 Drawing Sheets

U.S. PATENT DOCUMENTS 3,029,583 4/1962 Patt .
3,029,853 4/1962 Piazze .
3,058,402 10/1962 Kugler .
3,058,403 10/1962 Kugler .
3,077,295 2/1963 Whiteford .
3,078,895 2/1963 Silver .
3,119,549 1/1964 Schoen .
3,285,309 11/1966 Northcott .
3,406,610 10/1968 Golden .
3,409,209 11/1968 Finke .
3,414,032 12/1968 Jortikka .
3,418,891 12/1968 Rivman et al. .
3,425,470 2/1969 Wuest .
3,460,741 8/1969 Kugler .
3,484,325 12/1969 Pendleton .
3,506,048 4/1970 Jortikka .
3,532,639 10/1970 Hatch .
3,543,999 12/1970 Kugler .
3,547,341 12/1970 Kirkpatrick .
3,575,766 4/1971 McArthur et al. .
3,592,379 7/1971 Nakamura .
3,616,042 10/1971 Beyer et al. .
3,687,357 8/1972 Hansen .
3,738,568 6/1973 Ruda .
3,752,388 8/1973 Lynch .
3,759,772 9/1973 Andersson .
3,844,090 10/1974 Pepmeier .
3,865,303 2/1975 Korn .
3,909,330 9/1975 Schmermund .
3,935,048 1/1976 Rucker .
3,982,687 9/1976 Auer et al. .
4,140,046 2/1979 Marbach .
4,165,832 8/1979 Kuklies et al. .
4,202,721 5/1980 Roberts .
4,210,244 7/1980 Westrick .
4,260,003 4/1981 Hendrickson .
4,299,324 11/1981 Dickens .
4,349,104 9/1982 Hayes .
4,354,335 10/1982 Meyer .
4,360,398 11/1982 Sabee .
4,380,446 4/1983 Dickson et al. .
4,384,602 5/1983 Ores .
4,397,704 8/1983 Frick .
4,509,570 4/1985 Eby et al. .
4,547,237 10/1985 Hendrickson .
4,558,463 12/1985 Boyd .
4,592,091 5/1986 Italici .
4,597,750 7/1986 Boyd et al. .
4,617,008 10/1986 Boyd et al. .
4,624,654 11/1986 Boyd et al. .
4,628,536 12/1986 Herrington .
4,696,403 9/1987 Hoover .
4,714,143 12/1987 Saliba .
4,714,735 12/1987 Hodgson, Jr. et al. .
4,717,372 1/1988 Herrington .
4,717,373 1/1988 Catchman et al. .
4,721,501 1/1988 Herrington .
4,721,502 1/1988 Herrington .
4,746,391 5/1988 Heyse et al. .
4,747,701 5/1988 Perkins .
4,759,467 7/1988 Byrne .
4,762,430 8/1988 Bullard .
4,768,818 9/1988 Kolic .
4,769,126 9/1988 Roen et al. .
4,778,283 10/1988 Osborn .
4,786,189 11/1988 Broderick et al. .
4,786,191 11/1988 Broderick et al. .
4,786,275 11/1988 Hoover .
4,792,241 12/1988 Broderick et al. .
4,802,582 2/1989 Johnson .
4,813,792 3/1989 Belmont et al. .
4,813,793 3/1989 Belmont et al. .
4,813,794 3/1989 Herrington .
4,820,590 4/1989 Hodgson, Jr. et al. .
4,822,437 4/1989 Bryniarski et al. .
4,832,507 5/1989 Herrington .
4,832,677 5/1989 Hudgens et al. .
4,842,420 6/1989 DiBiasi et al. .
4,842,421 6/1989 Bullard et al. .
4,850,946 7/1989 Broderick et al. .
4,867,735 9/1989 Wogelius .
4,872,766 10/1989 Dancy .
4,880,316 11/1989 Belmont et al. .
4,889,522 12/1989 Gietman, Jr. .
4,895,611 1/1990 Bryniarski et al. .
4,930,905 6/1990 Sharps, Jr. .
4,938,607 7/1990 Kelley .
5,034,078 7/1991 Hodgson, Jr. et al. .
5,040,902 8/1991 Eaton et al. .
5,120,138 6/1992 Midgley et al. .
5,133,607 7/1992 Bonke .
5,232,118 8/1993 Samuel ..... 383/43 X
5,265,961 11/1993 Boyd .
5,272,236 12/1993 Lai et al. .
5,278,272 1/1994 Lai et al. .
5,395,471 3/1995 Obijeski et al. .
5,472,775 12/1995 Obijeski et al. .

ELASTIC TOP DRAWTAPE BAG AND METHOD OF MANUFACTURING THE SAME

FIELD OF THE INVENTION

The present invention relates generally to plastic bags and, more particularly, relates to a drawtape bag having an elastic top feature that enables the bag to be securely fitted to the upper portion of a trash container lined with the bag and, at the same time, does not interfere with the intrinsic strength and operation of the drawtape.

BACKGROUND OF THE INVENTION

Sealable polymeric packages, such as trash bags, are a common household item. The bags come to the consumer in the form of a roll of interconnected bags or as pre-separated bags housed in a dispensing box. When the bags are provided in the form of a roll, one end of the bag, the bottom, is thermally sealed closed and connected to its neighboring bag along a perforated line; the other end of the bag, the open mouth end, is attached to its neighboring bag solely along another perforated line. When the bags are pre-separated, neighboring bags are generally overlapped or interweaved in such a manner that removal of one bag from the dispensing box draws the neighboring bag toward an opening in the box.

In order to close a typical polymeric bag after it has been filled by the consumer, the bag body adjacent the open mouth end of the bag is gathered and tied into a knot or secured using a separate tie member supplied by the vendor of the bags. Tie members typically include paper coated flexible wires, rubber bands, or strips of plastic having a locking mechanism to provide a means to pull tight and securely fasten the neck of the bag. The need for separate tie members, however, adds an additional cost factor for the manufacturer, and ultimately, the consumer. In addition, separate tie members are easily lost and hence can be a nuisance for the consumer. Polymeric packages having integral closure systems overcome these problems. Such integral closure systems can be in the form of tie members, adhesives and the like.

One particularly advantageous closure system is a drawtape or drawstring that is integral to the bag body. Bags of this type are typically in the form of a pair of pliable thermoplastic body panels joined to each other along a pair of opposing sides and a bottom bridging the opposing sides. The bag may be opened along a mouth end formed opposite the bottom. The body panels form a hem along the mouth end of the bag, and the hem houses a pliable thermoplastic drawtape. One or more drawtape holes located within the hem expose the drawtape allowing it to be pulled through the holes to close the bag and to be used as a handle.

When consumers use a drawtape bag as a liner for a trash container, the bag body is inserted into the trash container such that the bag body generally extends downward into the trash container. The mouth end of the bag, including the hem, is drawn over and loosely mounted around an upper portion of the trash container. Heretofore, a shortcoming of such drawtape bags has been that the mouth end of the bag might fall back into the trash container, especially when consumers discard trash into the bag. This can be a nuisance for the consumer, who must then lift the mouth end of the bag out of the trash container and around the upper portion thereof. If the consumer does not notice that the mouth end of the bag has fallen into the trash container, the consumer might discard trash that is not captured by the drawtape bag but rather contacts and possibly sullies the inside wall of the trash container. This defeats the purpose of the bag, which is to serve as a liner for the trash container.

SUMMARY OF THE INVENTION

To overcome the foregoing problem, the present invention provides a drawtape bag having an elastic top feature that enables the bag to be securely fitted to the upper portion of a trash container lined with the bag. The elastic top feature is preferably constructed in such a manner that it does not interfere with the intrinsic strength and operation of the drawtape.

In one embodiment, the drawtape bag comprises a pair of pliable thermoplastic body panels joined to each other along a pair of opposing sides and a bottom bridging the opposing sides. The bag may be opened along the mouth end formed opposite the bottom. At least one of the body panels forms a hem along the mouth end of the bag, and the hem houses a pliable thermoplastic drawtape. One or more drawtape holes located within the hem expose the drawtape allowing it to be pulled through the holes to close the bag and to be used as a handle. The elastic top feature is provided by an elastomeric strip connected to a looped section of the drawtape housed within the hem. Specifically, the drawtape section is gathered into one or more loops defining a series of crests and troughs, and each trough is sealed to the elastomeric strip.

Drawtape bags are manufactured using the following method. First, a thermoplastic tube is extruded in a machine direction, flattened, and then slit in half along a center line. Each half of the tube includes a pair of pliable thermoplastic sheets joined to each other along a bottom disposed in the machine direction. The sheets are separable from each other along a mouth end formed opposite the bottom. Second, the sheets are passed through a static folding mechanism in the machine direction to produce a hem on each sheet along the mouth end. Third, drawtape holes are formed in the hem on each sheet at regular distance intervals corresponding to a width of the drawtape bags produced by the manufacturing method. The drawtape holes in the hem on one of the sheets coincide with the respective drawtape holes in the hem on the other of the sheets. Fourth, a pliable thermoplastic drawtape is inserted into the hem on each sheet. Prior to insertion, an elastomeric strip is attached to a looped section of the drawtape as described above. Fifth, the hem on each sheet is sealed to the respective sheet in the machine direction. Sixth, the drawtape housed within the hem on the one of the sheets is sealed to the drawtape housed within the hem on the other of the sheets at the locations of the coinciding drawtape holes. Seventh, the sheets are sealed to each other along side seal structures generally transverse to the machine direction and are separated at the side seal structures into the individual drawtape bags. The bags may then be packaged in a dispensing box for sale to consumers.

The above summary of the present invention is not intended to represent each embodiment, or every aspect of the present invention. This is the purpose of the figures and detailed description which follow.

BRIEF DESCRIPTION OF THE DRAWINGS

Other objects and advantages of the invention will become apparent upon reading the following detailed description and upon reference to the drawings in which.

Figure 1:
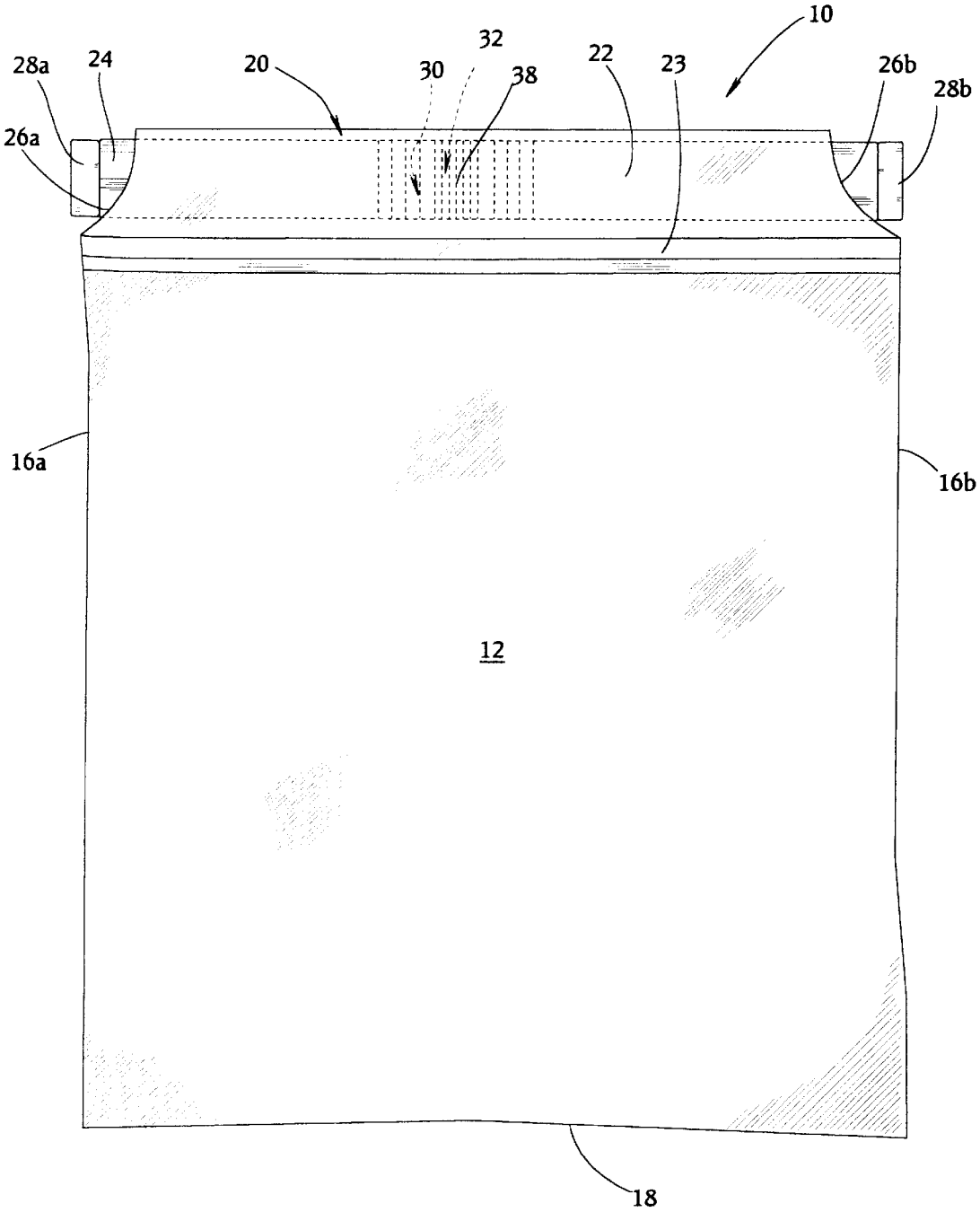
FIG. 1 is a top view of a drawtape bag with elastic top feature embodying the present invention.

While the invention is susceptible to various modifications and alternative forms, a specific embodiment thereof has been shown by way of example in the drawings and will be described in detail. It should be understood, however, that it is not intended to limit the invention to the particular form described, but, on the contrary, the intention is to cover all modifications, equivalents, and alternatives falling within the spirit and scope of the invention as defined by the appended claims.

DESCRIPTION OF ILLUSTRATIVE EMBODIMENTS

Turning now to the drawings, FIG. 1 illustrates a drawtape bag 10 comprising a pair of pliable thermoplastic body panels 12 and 14 (panel 14 is hidden beneath panel 12 in FIG. 1 but can be seen in FIG. 4) joined to each other along a pair of opposing sides 16*a* and 16*b* and a bottom 18 bridging the opposing sides 16*a* and 16*b*. The bag 10 may be opened along a mouth end 20 formed opposite the bottom 18. Each of the body panels 12 and 14 forms a respective hem 22 along the mouth end 20 of the bag 10. The hem 22 on each panel 12 and 14 houses a respective pliable thermoplastic drawtape 24. To maintain the drawtape 24 within the hem 22, the hem 22 is thermally sealed to the respective panel 12 and 14 along a respective hem seal 23.

Figure 5:
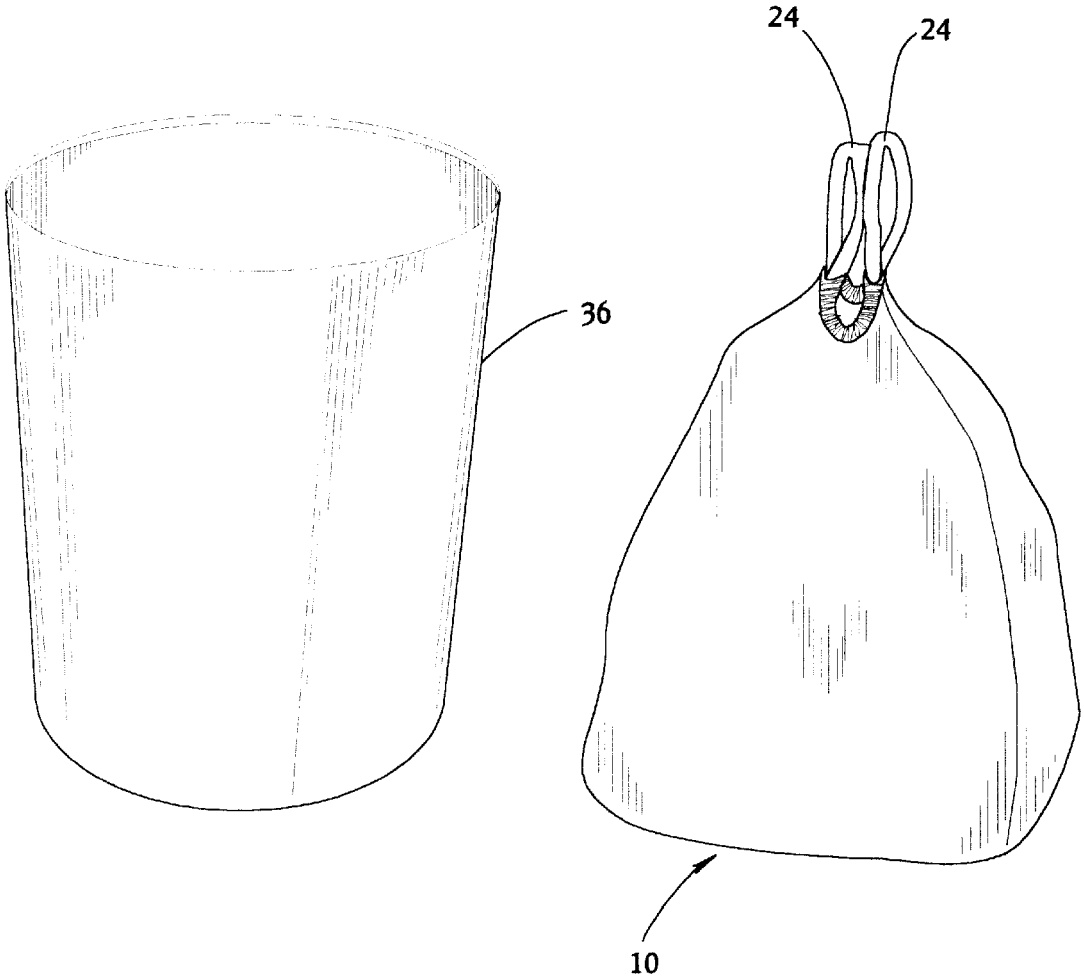
FIG. 5 is an isometric view of the drawtape bag removed from the trash container and closed using its drawtapes.

A pair of drawtape holes 26*a* and 26*b* are located in the hem 22 on each panel 12 and 14 at the respective sides 16*a* and 16*b*. The drawtape holes 26*a* and 26*b* in the hem 22 on the panel 12 coincide with the respective drawtape holes 26*a* and 26*b* in the hem on the other panel 14. The drawtape 24 housed within the hem 22 on the panel 12 is thermally sealed to the drawtape housed within the hem on the panel 14 at seals 28*a* and 28*b* coinciding with the respective drawtape holes 26*a* and 26*b*. The drawtape holes 26*a* and 26*b* provide a heat sealing bar with access to the drawtapes 24 for generating the drawtape seals 28*a* and 28*b*. Furthermore, when the drawtapes 24 are fully installed into the bag 10, the holes 26*a* and 26*b* expose the drawtapes 24 allowing them to be pulled through the holes 26*a* and 26*b* to close the bag and to be used as a handle as depicted in FIG. 5.

Figure 2:
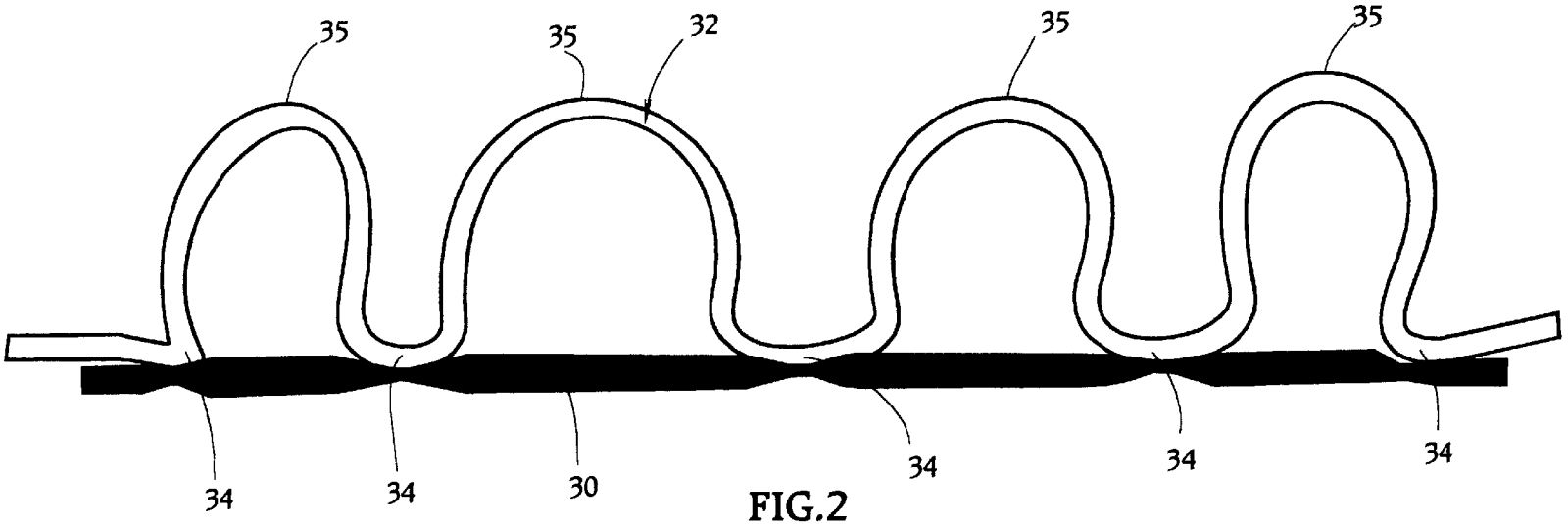
FIG. 2 is a cross-sectional view of an elastomeric strip attached to a looped section of a drawtape used in the drawtape bag, where the elastomeric strip is shown in unstretched form.

The drawtape bag 10 includes an elastic top feature that enables the bag 10 to be securely fitted to the upper portion of a trash container lined with the bag 10 and, at the same time, does not interfere with the intrinsic strength and operation of the drawtape 24. The elastic top feature is provided by an elastomeric strip 30 connected to a looped section 32 of the drawtape 24 housed within the hem 22 on each panel 12 and 14. Specifically, the drawtape section 32 is gathered into a plurality of loops defining a series of crests 35 and troughs 34, and each trough is thermally sealed to the elastomeric strip 30. This is best shown in FIG. 2, which is a cross-sectional view depicting the elastomeric strip 30 attached to the looped drawtape section 32 at the troughs 34. The elastomeric strip 30 has a total length of less than the length of the drawtape 24 and preferably about equal in dimension to the footprint of the looped drawtape section 32. The footprint of the looped drawtape section 32 may be defined as the horizontal distance between the leftmost trough 34 and the rightmost trough 34 as viewed in FIG. 2.

Referring back to FIG. 1, the drawtape 24 is sealed in four specific locations along the mouth end 20 of the bag 10. The drawtape seals 28*a* and 28*b* referenced above are two of these sealed locations. Third and fourth sealed locations are provided by an anchor seal 38 found in the center of the hem 22 on each panel 12 and 14. The anchor seal 38 unitizes the drawtape 24 with adjacent layers of the hem 22.

Figure 3:
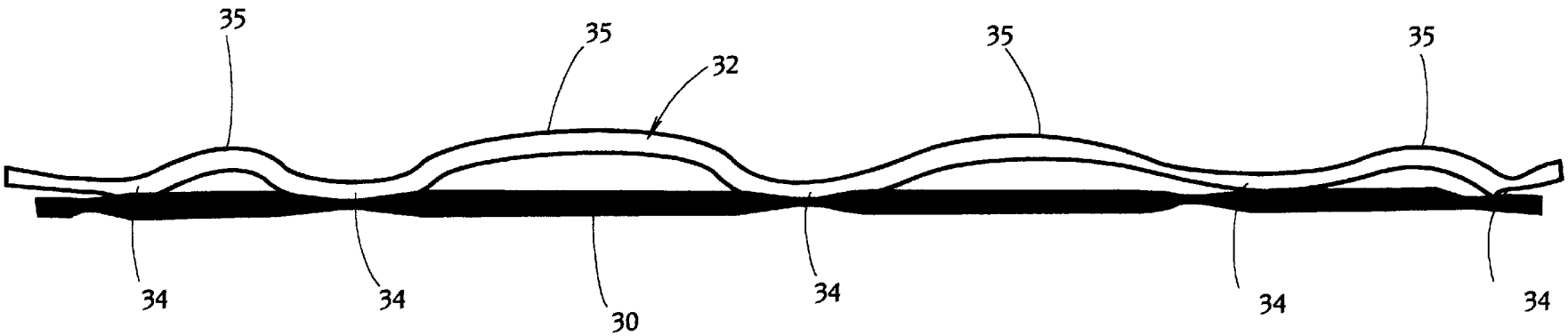
FIG. 3 is a cross-sectional view of the elastomeric strip attached to the looped drawtape section, where the elastomeric strip is shown in partially stretched form.
Figure 4:
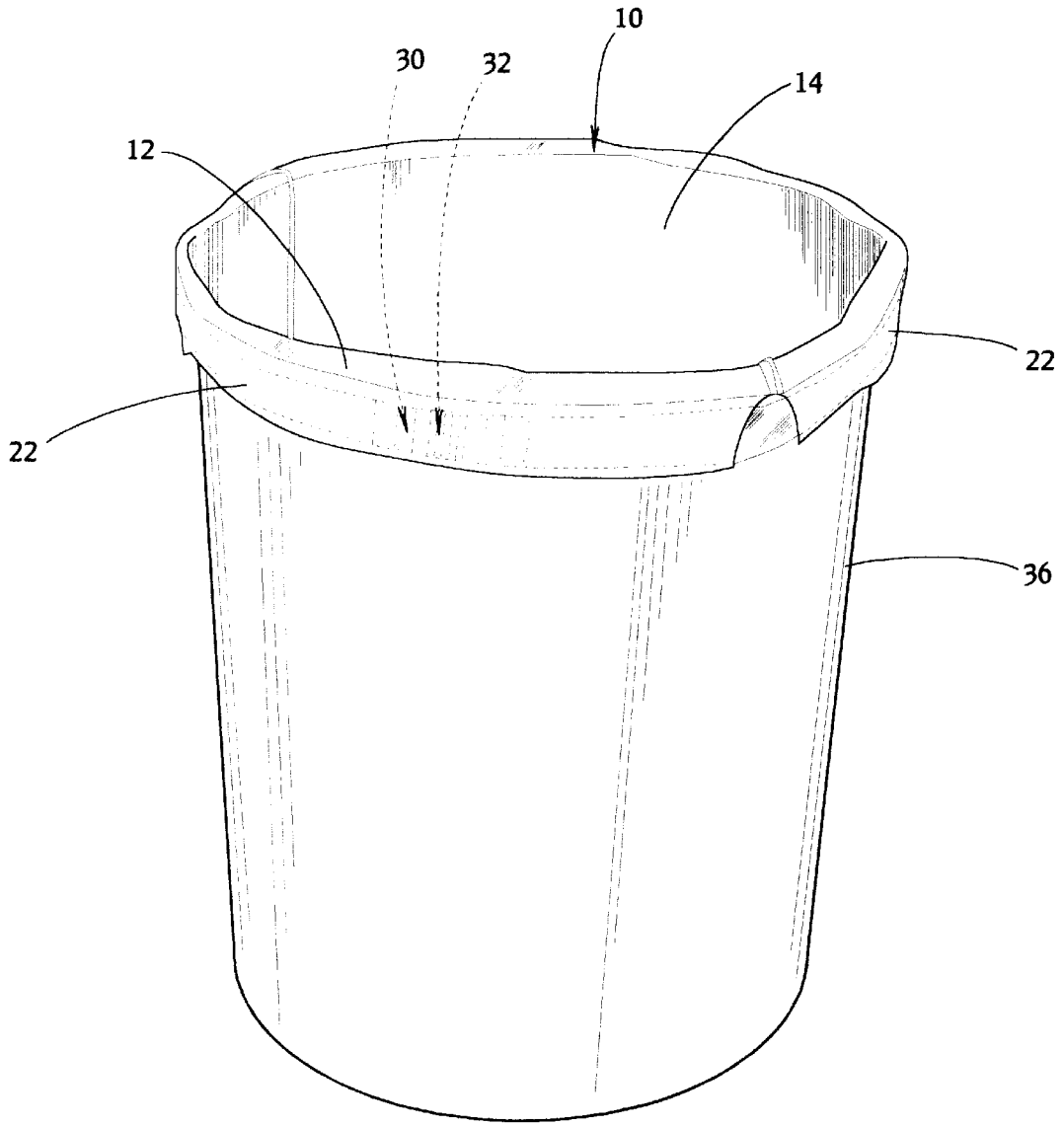
FIG. 4 is an isometric view of the drawtape bag securely mounted to a trash container.

Referring to FIG. 4, the elastomeric strip 30 allows the mouth end of the drawtape bag 10, including the hems 22, to be drawn over and securely mounted around an upper portion of a trash container 36. Depending upon the size of the trash container 36, mounting the bag 10 to the container 36 stretches the elastomeric strip 30, thereby increasing the "wavelength" of each loop in the looped drawtape section 32 and decreasing the height of the crests 35. FIG. 3 is a cross-sectional view of the elastomeric strip 30 attached to the looped drawtape section 32, where the elastomeric strip 30 is shown in partially stretched form. The elastomeric strip 30 can be stretched up to the point where the length of the stretched elastomeric strip 30 equals the length of the drawtape making up the looped drawtape section 32, i.e., where the "wavelength" of each loop reaches a maximum and the height of the crests 35 reaches zero. Beyond that point, the tensile characteristics of the non-elastic drawtape 24 control the behavior of the two component construction, one component being provided by the drawtape 24 and the other component being provided by the elastomeric strip 30. The two component construction effectively combines the elastic behavior of the elastomeric strip 30 with the strength characteristics of the non-elastic drawtape 24.

Figure 6:
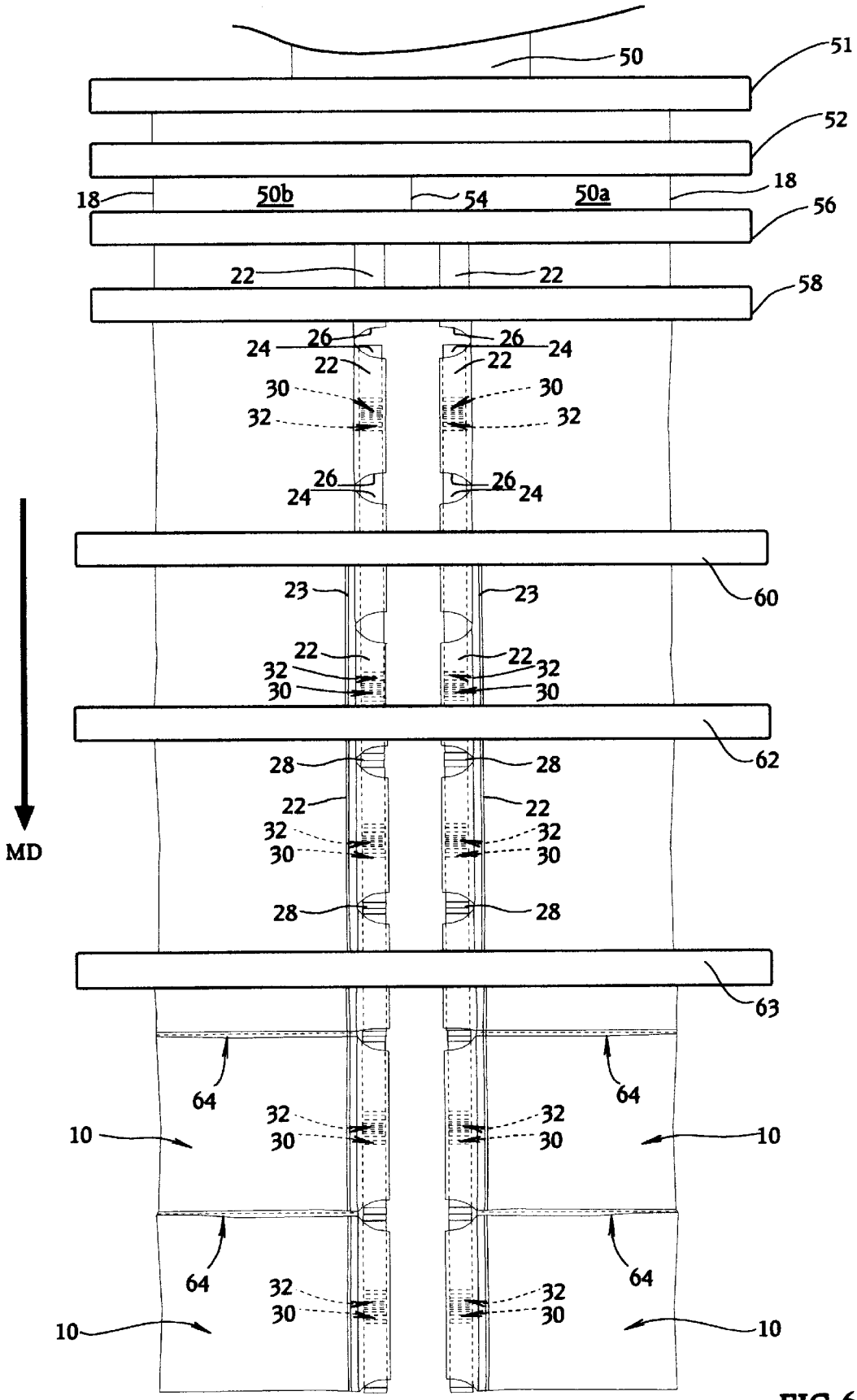
FIG. 6 is a schematic view of a method of manufacturing the drawtape bag.

FIG. 6 is a schematic view of a method of manufacturing drawtape bags 10. First, a thermoplastic tube 50 is extruded in a machine direction, flattened by rollers in a flattening mechanism 51, and then slit in half by a static slitting mechanism 52 along a center line 54. Each half 50a and 50b of the tube 50 includes a pair of pliable thermoplastic sheets joined to each other along a bottom 18 disposed in the machine direction. The machine direction is designated by an arrow labeled MD in FIG. 6. The sheets are separable from each other along a mouth end proximate to center slit line 54 and opposite the bottom 18.

Second, the sheets are passed through a static folding mechanism 56 in the machine direction (MD) to produce a hem 22 on each sheet along the mouth end 20.

Third, a single-hole cutting mechanism 58 creates drawtape holes 26 in the hem 22 on each sheet at regular distance intervals corresponding to a predetermined width of the drawtape bags 10 produced by the manufacturing method. The drawtape holes 26 in the hem 22 on one of the sheets coincide with the respective drawtape holes in the hem on the other of the sheets.

Fourth, a pliable thermoplastic drawtape 24 from a supply roll (not shown) is continuously fed and inserted into the hem 22 on each sheet. The drawtape 24 has looped sections 32 disposed at regular distance intervals along the drawtape 24 corresponding to the predetermined width of the drawtape bags 10 produced by the manufacturing method. Prior to insertion, elastomeric strips 30 are attached to the respective looped sections 32 of the drawtape 24 as described above in connection with FIGS. 1–5.

Fifth, a static heat sealing mechanism 60 generates a hem seal 23 in the machine direction (MD) which attaches the hem 22 on each sheet to the respective sheet.

Sixth, a heat sealing mechanism 62 generates drawtape seals 28 which attach the drawtape 24 housed within the hem 22 on the one of the sheets to the drawtape housed within the hem on the other of the sheets at the locations of the coinciding drawtape holes 26. These drawtape seals 28 are transverse to the machine direction (MD). The heat sealing mechanism 62 also creates the anchor seal 38 (see FIG. 1).

Seventh, a heat sealing and perforation mechanism 63 generates side seal structures 64 transverse to the machine direction (MD) and disposed at regular distance intervals corresponding to the predetermined width of the drawtape bags 10 produced by the manufacturing method. Each side seal structure 64 includes a perforation line disposed between a pair of spaced seal lines. The perforation line allows the sheets to be separated into the individual drawtape bags 10. The bags 10 may then be packaged in a dispensing box for sale to consumers.

With respect to a prototypical drawtape bag embodying the present invention, the body panels 12 and 14 can be composed of a wide range of polymeric materials such as linear low density polyethylene (LLDPE), low density polyethylene (LDPE), high pressure polyethylene (HPPE), high molecular weight high density polyethylene (HDPE), polyester, polystyrene, or blends of these polymers. In addition, the body panels may be composed of coextruded films uniting two or more of the above polymers. Each panel preferably has a thickness ranging from about 0.4 mil to about 2 mils.

The drawtape 24 is composed of a polymeric material having a high yield strength and low elasticity in the draw direction. These properties mean that when the drawtape 24 is subjected to high stresses in the draw direction, the drawtape 24 substantially maintains its shape and does not stretch from its original length. When some prior art drawtapes are pulled hard to close the bag, the drawtape elongates over most of its length and the area where it is gripped by the hand becomes narrow, or "ropes," and hurts the hand. The polymeric material of the drawtape 24 minimizes this "roping" effect. Suitable polymers include, but are not limited to, high molecular weight high density polyethylene, medium density polyethylene (MDPE), linear low density polyethylene, and low density polyethylene. The drawtape 24 preferably has a thickness ranging from about 1 mil to about 5 mils, where a thicker drawtape is desired for bags intended to carry heavier loads.

The elastomeric strip 30 is composed of a polymeric material, such as elastomeric polyethylene, having a low yield strength and high elasticity relative to the respective yield strength and elasticity of the drawtape 24. These properties mean that when the elastomeric strip 30 is subjected to high stresses, the strip 30 can stretch to several times its original length without changing its shape upon return to its original length. The elastomeric strip 30 preferably has a thickness ranging from about 1 mil to about 10 mils.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A drawtape bag comprising:

a pair of pliable thermoplastic body panels joined to each other along a pair of opposing sides and a bottom bridging the opposing sides, at least one of the body panels forming a hem extending along a mouth end disposed opposite the bottom, the hem including one or more drawtape holes;

a pliable thermoplastic drawtape housed within the hem, the drawtape including a looped section gathered into one or more loops defining a series of crests and troughs, the drawtape being partially exposed the drawtape holes which allow the drawtape to be pulled therethrough to close the bag and to be used as a handle; and an elastomeric strip connected to the troughs of the looped section of the drawtape.

2. The drawtape bag of claim 1, wherein the elastomeric strip is thermally sealed to the troughs of the looped section of the drawtape.

3. The drawtape bag of claim 1, wherein the elastomeric strip has a total length less than a length of the drawtape.

4. The drawtape bag of claim 3, wherein the elastomeric strip has a total length about equal to a length of a footprint of the looped section of the drawtape.

5. The drawtape bag of claim 1, wherein the hem, the elastomeric strip, and the looped section of the drawtape are sealed to each other at an anchor seal.

6. The drawtape bag of claim 5, wherein the anchor seal is located at a central one of the troughs of the looped section of the drawtape.

7. The drawtape bag of claim 1, wherein the elastomeric strip has an elasticity greater than that of the drawtape and a yield strength less than that of the drawtape.

8. The drawtape bag of claim 7, wherein the elastomeric strip is composed of elastomeric polyethylene, and wherein the drawtape is composed of a polymeric material selected from a group consisting of high molecular weight high density polyethylene, medium density polyethylene, linear low density polyethylene, and low density polyethylene.

9. A drawtape bag comprising:

a pair of pliable thermoplastic body panels joined to each other along a pair of opposing sides and a bottom bridging the opposing sides, the body panels forming respective hems extending along a mouth end disposed opposite the bottom, each of the hems including one or more respective drawtape holes;

a pair of pliable thermoplastic drawtapes housed within the respective hems and being sealed to each other, each of the drawtapes including a respective looped section gathered into one or more loops defining a series of crests and troughs, each of the drawtapes being partially exposed by the respective drawtape holes which allow the respective drawtape to be pulled therethrough to close the bag and to be used as a handle; and a pair of elastomeric strips connected to the troughs of the looped section of the respective drawtapes.

10. The drawtape bag of claim 9, wherein the drawtape holes in each of the respective hems are located at the opposing sides, the drawtape holes in the hem on one of the body panels generally coinciding with the respective drawtape holes in the hem on the other of the body panels.

11. The drawtape bag of claim 10, wherein the drawtapes are sealed to each other at a pair of drawtape seals coinciding with the drawtape holes.

12. The drawtape bag of claim 11, wherein the hems are sealed to the respective body panels along respective hem seals extending along the mouth end of the bag.

13. The drawtape bag of claim 12, wherein the hems, the elastomeric strips, and the looped section of each drawtape are sealed to each other at anchor seals.

14. A method of manufacturing drawtape bags, comprising:

forming a flattened thermoplastic tube in a machine direction;

dividing the thermoplastic tube into first and second portions along a dividing line extending in the machine direction, each of the portions including a pair of pliable thermoplastic sheets joined to each other along a bottom disposed in the machine direction, the sheets being separable from each other along a mouth end formed opposite the bottom;

forming a hem on at least one of the sheets along the mouth end;

forming drawtape holes in the hem at regular distance intervals corresponding to a desired width of the drawtape bags;

inserting a pliable thermoplastic drawtape into the hem, the drawtape including a looped section gathered into one or more loops defining a series of crests and troughs, an elastomeric strip being connected to the troughs of the looped section of the drawtape; and sealing the sheets to each other along side seal structures generally transverse to the machine direction to create individual drawtape bags.

15. The method of claim 14, wherein the elastomeric strip has a total length less than a length of the drawtape.

16. The method of claim 15, wherein the elastomeric strip has a total length about equal to a length of a footprint of the looped section of the drawtape.

17. The method of claim 14, further including the step of sealing the hem, the elastomeric strip, and the looped section of the drawtape to each other at an anchor seal.

18. The method of claim 14, wherein the elastomeric strip has an elasticity greater than that of the drawtape and a yield strength less than that of the drawtape.

19. A method of manufacturing drawtape bags, comprising:

extruding a thermoplastic tube in a machine direction;

flattening the thermoplastic tube;

slitting the thermoplastic tube generally in half along a cut line extending in the machine direction, each half of the tube including a pair of pliable thermoplastic sheets joined to each other along a bottom disposed in the machine direction, the sheets being separable from each other along a mouth end formed opposite the bottom;

folding the sheets along the mouth end to produce a hem on each sheet;

forming drawtape holes in the hem on each sheet at regular distance intervals corresponding to a desired width of the drawtape bags, the drawtape holes in the hem on one of the sheets generally coinciding with the respective drawtape holes in the hem on the other of the sheets;

inserting a pliable thermoplastic drawtape into the hem on each sheet, the drawtape including a looped section gathered into one or more loops defining a series of crests and troughs, an elastomeric strip being connected to the troughs of the looped section of the drawtape;

sealing the hem on each sheet to the respective sheet in the machine direction;

sealing the drawtape housed within the hem on the one of the sheets to the drawtape housed within the hem on the other of the sheets at the locations of the generally coinciding drawtape holes; and sealing the sheets to each other along side seal structures generally transverse to the machine direction to create the individual drawtape bags.

* * * * *